US006711372B1

(12) United States Patent
Noda et al.

(10) Patent No.: US 6,711,372 B1
(45) Date of Patent: Mar. 23, 2004

(54) DEVELOPING APPARATUS

(75) Inventors: Nobutaka Noda, Ota-ku (JP); Joji Ota, Ota-ku (JP); Kenichi Tanaka, Ota-ku (JP); Hiroto Mikado, Ota-ku (JP)

(73) Assignee: Katsuragawa Denki Kabushiki Kaisha (JP)

( * ) Notice: Subject to any disclaimer, the term of this patent is extended or adjusted under 35 U.S.C. 154(b) by 84 days.

(21) Appl. No.: 10/030,698

(22) PCT Filed: Aug. 18, 2000

(86) PCT No.: PCT/JP00/05541

§ 371 (c)(1),
(2), (4) Date: Jan. 14, 2002

(87) PCT Pub. No.: WO01/14935

PCT Pub. Date: Mar. 1, 2001

(30) Foreign Application Priority Data

Aug. 19, 1999 (JP) ..... 11-233233
Aug. 19, 1999 (JP) ..... 11-233236
Feb. 24, 2000 (JP) ..... 2000-46662

(51) Int. Cl.[7] ..... G03G 15/08
(52) U.S. Cl. ..... 399/286; 399/234; 399/284
(58) Field of Search ..... 399/234, 235, 399/274, 279, 284, 286, 228, 236

(56) References Cited

U.S. PATENT DOCUMENTS 4,975,746 A * 12/1990 Miyauchi et al. ..... 399/111
4,989,037 A * 1/1991 Nagatsuna ..... 399/167
5,126,800 A * 6/1992 Shishido et al. ..... 399/111
5,258,811 A * 11/1993 Miyake et al. ..... 399/167
5,557,060 A 9/1996 Okada et al.
5,581,336 A * 12/1996 Matsuzaki et al. ..... 399/270
6,163,669 A * 12/2000 Aoki et al. ..... 399/159
6,178,303 B1 * 1/2001 Ishii et al. ..... 399/236
6,229,979 B1 * 5/2001 Ishii et al. ..... 399/281
6,505,014 B2 * 1/2003 Aoki et al. ..... 399/55

FOREIGN PATENT DOCUMENTS

EP 0 992 861 A2 4/2000
JP 57-93376 6/1982
JP 59-223469 12/1984
JP 62-223771 10/1987
JP 04-76565 3/1992
JP 06-258932 9/1994
JP 07-234552 9/1995
JP 02-598131 1/1997
JP 2598131 1/1997
JP 2803822 7/1998
JP 2815888 8/1998
JP 11-212341 6/1999
JP 2001194901 A * 7/2001 ..... G03G/15/08

* cited by examiner

*Primary Examiner*—Robert Beatty
(74) *Attorney, Agent, or Firm*—Parkhurst & Wendel, L.L.P.

(57) ABSTRACT

A developing apparatus having a resilient developing roller for developing an image with a single-component toner includes a contacting mechanism for moving the developing roller into contact with a surface of an image carrier for developing the image and moving the developing roller in a forward direction at substantially the same speed as the image carrier. The width of a developing nip and a depth of bite between the image carrier and developing roller is set such that the traveling speed of the local portion of the developing roller that contacts the image carrier gradually decreases from a point at which contact starts and then gradually returns to the original speed. The width of the developing nip is at least 4 mm, the hardness of the developing roller is 20–40 degrees, the diameter of the developing roller is 40–100 mm, and the bite depth is equal to or greater than 1/100 the radius of the developing roller. The developing apparatus can also include a layer thickness regulating roller has end portions that prevent adhesion of toner thereto, the contacting mechanism includes gears on the image carrier and developing roller that are slightly meshed even when the developing roller is out of contact with the image carrier, and the image size being at least an A2 size.

21 Claims, 5 Drawing Sheets

DEVELOPING APPARATUS

TECHNICAL FIELD

This invention relates to a developing apparatus used in an electrophotographic apparatus and, more particularly, to a developing apparatus in which an electrostatic latent image formed on an image carrier is developed and visualized by a non-magnetic single-component developer.

BACKGROUND ART

Generally, in an electrophotographic apparatus such as a copier, printer or plotter that utilizes electrophotography, the electrostatic latent image of a desired image is formed on an image carrier such as a photosensitive drum and a developer is supplied by a developing apparatus to develop the electrostatic latent image so that a visible toner image is formed on the image carrier. A two-component developer comprising toner and carrier, and a magnetic single-component developer or non-magnetic single-component developer comprised of toner alone are known as developers. Various developing systems suited to these developers have been developed and proposed.

Non-magnetic single-component developers in particular have various advantages but utilization thereof in actual machines has been slow. In recent years, however, utilization in actual machines has spread rapidly with the development of new or improved developers, which are the result of performance enhancement, such as polymer toners that excel in image reproducibility and transfer.

A contact-type developing apparatus has been proposed as a developing apparatus that uses a non-magnetic single-component developer, in which a flexible developing roller exhibiting electroconductivity or an appropriate electrical resistance is used as a developer carrier for supplying a developer to an image carrier, a thin layer of the developer is formed on the surface of the roller and then the roller is brought into contact with the surface of the image carrier at a suitable pressure to develop the image. It is known that such a contact-type developing apparatus can be used preferably in development which does not require an edge enhancement effect and in which it is required that the developing characteristics of line drawings and pictorial images be identical, as in a digital printer in which an image is formed by monochrome bi-level values. This is known also as a cleanerless system because cleaning can be carried out at the same time as development.

In an early apparatus of this kind, the arrangement is such that a physical or mechanical load brought about by contact between the developing roller and the surface of the image carrier is mitigated by making the peripheral speed of the elastic developing roller, which rotates in the forward direction, and the peripheral speed of the image carrier approximately identical. However, difficulties arise in terms of image quality relating to image definition, texture smudging and fogging. An arrangement which provides a difference in speed between the peripheral speed of the image carrier and the peripheral speed of the developing roller has been proposed as an improvement (e.g., see the specifications of Japanese Patent Nos. 2598131 and 2803822).

In accordance with the proposed apparatus, the surface of the developing roller is brought into sufficient sliding frictional contact with the surface of the image carrier via a toner layer owing to the difference in the peripheral speeds between the developing roller and image carrier, whereby excellent development and cleaning are carried out simultaneously. In order to achieve such sliding frictional contact, the developing roller is set to as to rotate at a peripheral speed that is 1.5 to 4 times that of the image carrier. Further, it is disclosed that the contact width between the developing roller and surface of the image carrier, namely the development nip zone, should be equal to or more than 50 times but equal to or less than 500 times the volume average particle diameter of the developer particles.

In experiments, however, the Inventors have found that several problems still need to be solved in terms of structure and requirements in order to obtain fully satisfactory image quality, especially the fact that some points that do not give rise to problems in small type printers that develop small-size images do represent major problems when developing large-size images such as images of size A2, A1 and A0 by large type printers.

One problem is as follows: When the force with which the developing roller comes into pressured contact with the image carrier is comparatively large and the peripheral speed of the developing roller differs from that of the image carrier, the toner on the surface of the developing roller is pulverized by the pressure of sliding contact, resulting in rapid toner deterioration. Further, toner adheres to (or becomes fused to) the surface of a developer-layer regulating member, which regulates the thickness of the layer of developer that is formed on the developing roller, owing to the development of, say, several thousand meters, and the adherence of the toner prevents the formation of a uniform thin layer of the developer, thereby causing white stripes to appear on the image. An additional drawback is that the image carrier rotates unevenly owing to the action of pressing force applied to the image carrier by the developing roller rotating at a different peripheral speed. Furthermore, in a large-size electrophotographic apparatus for developing large-size images, the torque for driving the developing roller is fairly large in order to produce the aforementioned sliding contact. This is uneconomical.

Further, in the prior art described above, maintaining the width of the development nip zone ("nip width") is a major factor in achieving good development and the nip width is to be made 50 to 500 times the average particle diameter of the toner. Accordingly, if the diameter of the toner used in such development is on the order of 8 $\mu$m, the nip width will be 0.4 to 4 mm, which is 50 to 500 times this diameter. In a case where a developing roller having a diameter of 40 mm is made to contact an image carrier having a diameter of 120 mm, for example, the positional dimensions between the developing roller and image carrier must be maintained in such a manner that the depth of bite of the developing roller into the image carrier will be 0.001 to 0.134 mm. Considerable dimensional precision and setting of position will be required of these members.

Even if this is a soluble problem in a small-size developing apparatus of size A4 or A3 having an image carrier or developing roller of comparatively small length, it is a problem of considerable difficulty in a large-size developing apparatus having a developing roller of large length. For example, finishing of the developing roller usually is performed by grinding. In an instance where an A0-size image is to be developed, a roller having a length of about 850 mm must be machined as the developing roller. Finishing the roller to a diametric error of tens of microns over its entire length so as to satisfy the above requirement is considerably difficult and results in costly machining. Further, in a case where the amount of wobble of an A0-size image carrier at rotation thereof and the amount of wobble of the developing roller are each 0.1 mm and, hence, there is an error in the diameter between these members, the depth of bite of the developing roller into the surface of the image carrier varies from area to area and, as a result, image density varies locally and gives rise to uneven development.

In addition, a developing roller made of a resilient material such as rubber exhibits a large coefficient of thermal expansion and therefore the diameter thereof tends to change with a change in ambient temperature. As a result, a problem which arises is that the nip width between the image carrier and developing roller varies with a change in temperature. This is a further cause of uneven development.

Thus, in the prior art as described above, satisfactory mechanical precision for coping with the environment of use is difficult to obtain in cases where a large-size image is developed. As a result, stable, uniform images cannot be obtained consistently.

Furthermore, leakage of toner from both ends of the developing roller to the exterior of the developing apparatus is one problem with a contact-type developing apparatus that uses non-magnetic single-component toner. That is, because of the non-magnetic nature of the toner, the toner cannot be gathered together by magnetic force as in the manner of the conventional magnetic-developer system. Several alternative proposals for preventing such leakage have been made.

Most of these proposals place a lubricating seal between both ends of the developing roller and the side plates of the developing apparatus, thereby attempting to prevent leakage of the toner. However, in an arrangement in which such seals are placed, the seals wear out or deteriorate owing to long-term use and a satisfactory sealing effect cannot be maintained.

DISCLOSURE OF THE INVENTION

The present invention has been devised in view of the above-mentioned circumstances and seeks to provide a developing apparatus in which excellent development is possible at all times even when developing large-size images of size A0 and A1. A further object of the present invention is to provide a developing apparatus in which amount of bite of a resilient developing roller into an image carrier and width of a development nip zone can be made suitable values for the sake of achieving the excellent development mentioned above.

A further object of the present invention is to provide a developing apparatus in which it is possible to prevent toner leakage through a simple arrangement by utilizing a layer-thickness regulating roller for forming a thin layer on a developing roller.

According to the present invention, the foregoing objects are attained by providing a developing apparatus for forming a thin layer of toner, which comprises a non-magnetic single-component toner, on a resilient developing roller, bringing the roller into abutting contact with the surface of an image carrier, whereby toner on the resilient developing roller is supplied to an electrostatic latent image that has been formed on the surface of the image carrier, thereby developing the electrostatic latent image, and moving the image carrier and the resilient developing roller in a forward direction in such a manner that traveling speed of the image carrier and peripheral speed of the resilient developing roller become substantially identical, wherein width of a development nip zone that extends from a point at which the resilient developing roller starts to contact the image carrier to a point at which the resilient developing roller breaks contact with the image carrier is equal to or greater than 4 mm, preferably 5 to 10 mm, rubber hardness of the resilient roller is 20 to 40° and diameter of the resilient developing roller falls within the range 40 to 100 mm, and amount of bite by which the surface of the image carrier bites into the resilient developing roller is set so as to be equal to or greater than 1/100 of the radius of the resilient developing roller, characterized in that the amount of bite and the width of the development nip zone are set in such a manner that the resilient developing roller breaks contact with the image carrier while traveling speed of a local portion of the resilient developing roller in contact with the surface of the image carrier gradually decreases from the point at which contact starts and thenceforth gradually returns to the original speed owing to resilience of the resilient developing roller per se.

Further, the amount of bite of the resilient developing roller into the surface of the image carrier is set so as to be equal to or greater than 1/40 of the radius of the developing roller.

Further, the depth of bite of the resilient developing roller into the surface of the image carrier is set to be equal to or greater than 1/100 of the radius of the developing roller. In particular, the depth of bite is set to 0.2 to 3 mm. Further, it is preferred that the thin layer of toner formed on the resilient developing roller be a uniform layer of one to three layers of toner.

Furthermore, rubber hardness of the resilient roller is 20 to 40°, as measured according to the JIS K 6253 (Type A) standard.

Means for forming the thin toner layer on the resilient developing roller comprises a layer-thickness regulating roller placed in opposition to the developing roller.

The layer-thickness regulating roller has a central portion along the axial direction thereof and end portions that are electrically insulated from the central portion, and a bias voltage for preventing adhesion of toner to the end portions of the resilient developing roller is applied to the end portions.

Further, the apparatus is equipped with a scraping blade provided in pressured contact with a central portion of the layer-thickness regulating roller with respect to the axial direction thereof and with end portions of the roller, the scraping blade being so adapted as to scrape off toner that has adhered to the layer-thickness regulating roller.

Further, the developing roller is provided so as to be capable of contacting and separating from the surface of the image carrier in order to assure a suitable positional relationship between the developing roller and image carrier, both ends of the developing roller are provided with contact rollers, and the contact rollers are brought into abutting contact with both ends of the image carrier to regulate the width of the development nip zone.

Furthermore, the image carrier and developing roller are moved so as to mesh a gear provided on a flange of the image carrier with a gear provided on an end of the developing roller, whereby drive from the image carrier is transmitted to the developing apparatus.

In particular, the developing apparatus is characterized by further having separation means for causing the developing roller to separate from the image carrier, wherein the gear provided on the image carrier and the gear provided on the developing roller are made to mesh slightly when the image carrier and the developing roller are in a separated state.

Further, the present invention is characterized by having a cam in abutting contact with a portion of the developing apparatus for being turned at introduction of power to thereby move the developing apparatus in such a manner that the developing roller is pressed against the image carrier, and by provision of a capacitor charged when power is being introduced, wherein the capacitor is switched over to act as a power source at cut-off of power, thereby rotating the cam and moving the developing apparatus in such a manner that the developing roller moves in a direction in which it separates from the image carrier.

Furthermore, in accordance with the present invention, there is provided a developing apparatus for forming a thin layer of toner, which comprises a non-magnetic single-component toner, on a resilient developing roller, and bringing the roller into abutting contact with the surface of a drum-shaped image carrier, whereby toner on the resilient developing roller is supplied to an electrostatic latent image that has been formed on the surface of the image carrier, thereby developing the electrostatic latent image, characterized by comprising: means for rotating the image carrier and the resilient developing roller in a forward direction in such a manner that peripheral speed of the image carrier and peripheral speed of the resilient developing roller become substantially identical; and means for regulating depth of bite of the resilient developing roller into the surface of the image carrier and width of a development nip zone that extends from a point at which the resilient developing roller starts to contact the image carrier to a point at which the resilient developing roller breaks contact with the image carrier.

Furthermore, the invention is characterized in that the moving means comprises mutually meshing gears formed on ends of respective ones of the image carrier and developing roller, and in that the regulating means comprises rollers provided on both ends of the developing roller and the peripheral surfaces of which are brought into abutting contact with both ends of the image carrier.

BEST MODE FOR CARRYING OUT THE INVENTION

A preferred embodiment of the present invention will now be described with reference to the drawings.

Figure 1:
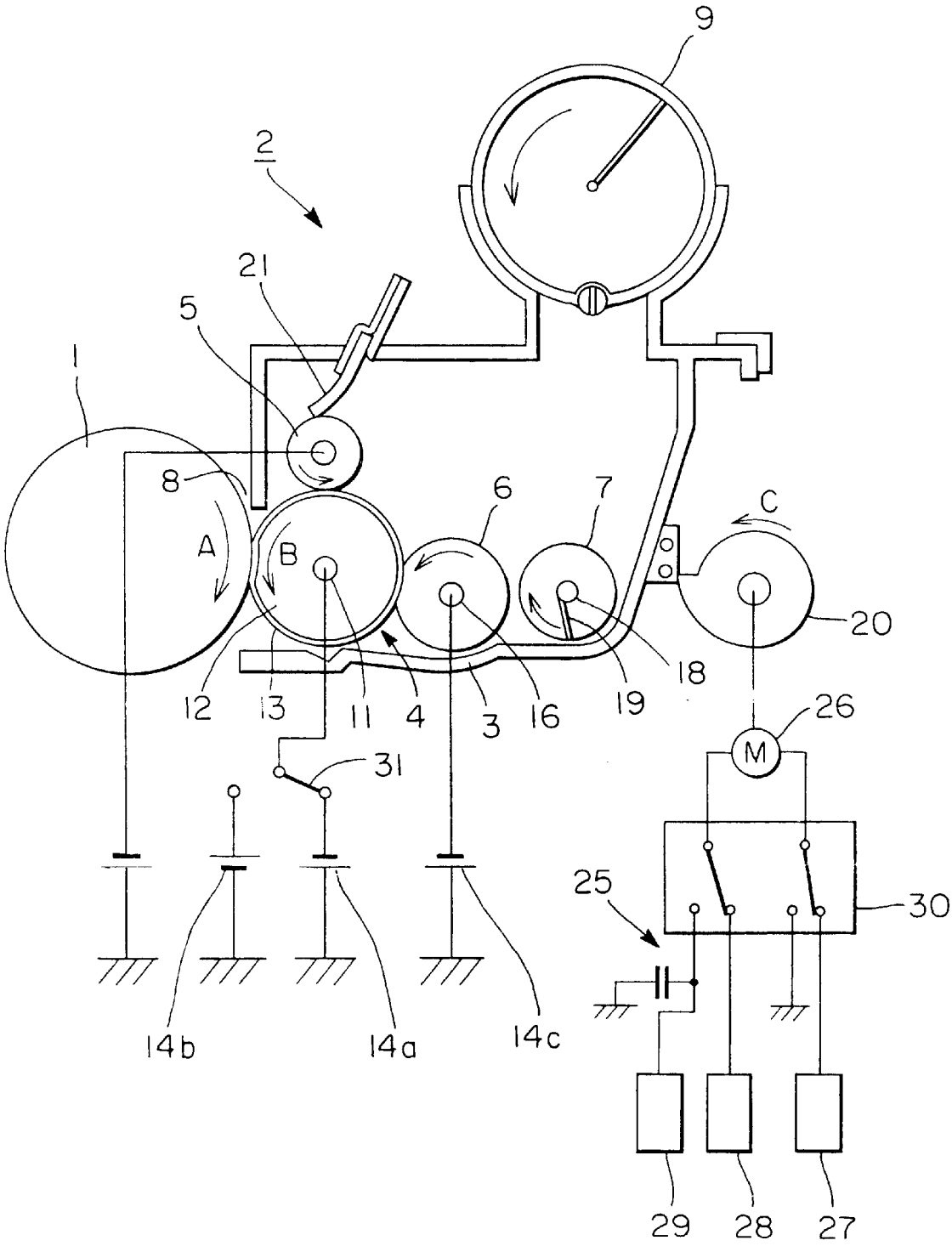
FIG. 1 is a schematic side view illustrating a preferred embodiment of a developing apparatus according to the present invention.
Figure 2:
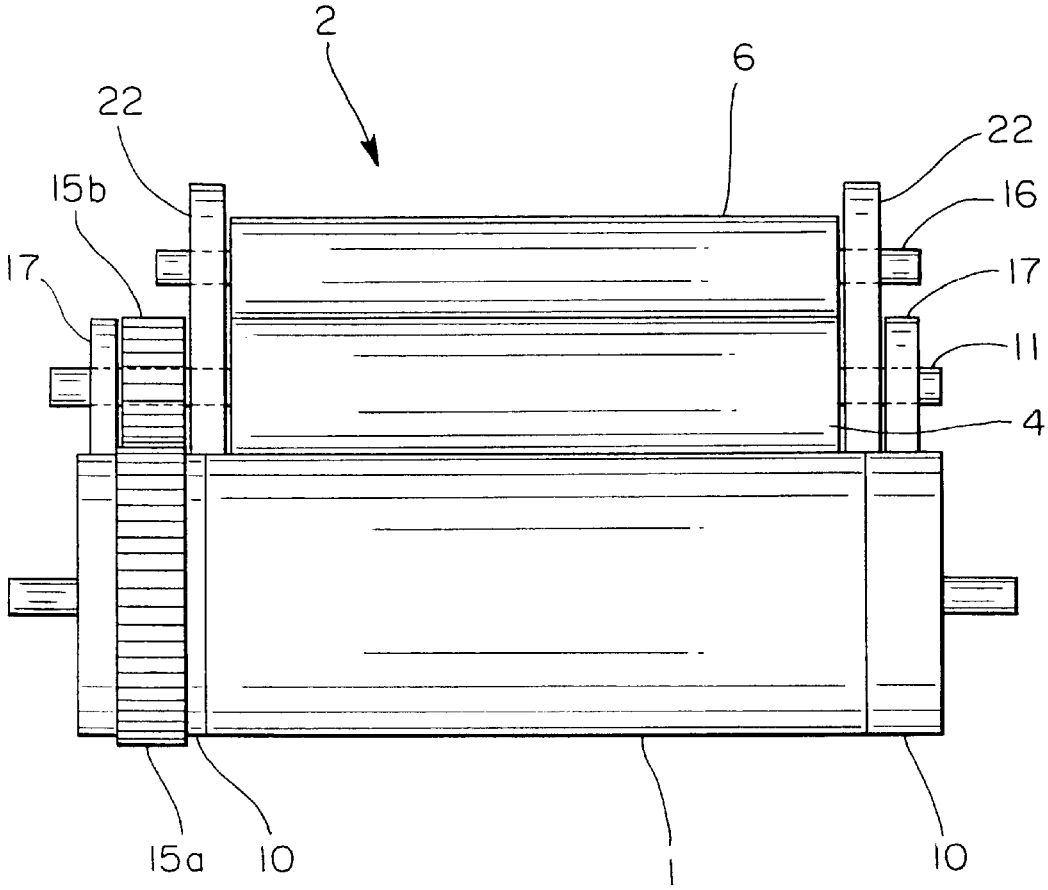
FIG. 2 is a schematic top view of the developing apparatus according to the present invention.

FIG. 1 is a schematic side view of a developing apparatus to which the present invention is applied, and FIG. 2 is a schematic top view. In the Figures, numeral 1 denotes an image carrier moved in the direction indicated by arrow A, namely in the clockwise direction. By way of example, the image carrier comprises an arrangement in which the surface of a drum-shaped substrate made of aluminum or the like is equipped with an electrophotographic photosensitive drum. A well-known photosensitive drum such as an OPC (Organic Photo-Conductor) photosensitive drum or amorphous silicon photosensitive drum can be used as the image carrier 1. It should be noted that the image carrier 1 may have a shape other than that of a drum, namely the shape of a belt.

Though not shown (with the exception solely of the developing apparatus), the following are disposed about the periphery of the image carrier 1 along the direction A of rotation: an eraser lamp for erasing residual electric charge from the image carrier 1; a charging device for charging the image carrier 1 uniformly to a specific polarity; an exposure device such as an LED head for forming an electrostatic latent image on the image carrier 1 by causing digital light information to impinge upon the surface of the electrically charged image carrier 1; a developing apparatus 2 (FIG. 1) for reversal-developing the electrostatic latent image by supplying toner to the image carrier 1, i.e., for forming a toner image by causing toner to affix itself to the exposed portion; a post-lamp for assisting in improving the toner transfer efficiency by uniformly de-electrifying the image carrier 1 and toner by uniformly exposing the surface of the image carrier 1 carrying the toner image; and a transfer device for transferring the toner image on the image carrier 1 to a transfer material such as paper. These unillustrated components surrounding the image carrier 1 can be selected from among well-known devices with the exception of the illustrated developing apparatus 2.

In this arrangement, the developing apparatus 2 has a developing vessel 3 accommodating a single-component developer (referred to as "a non-magnetic single-component toner" or simply "toner" below) comprising an insulating non-magnetic toner; a developing roller 4 comprising a resilient body; a layer-thickness regulating roller 5, which is placed so as to contact the developing roller 4 at a suitable pressure, for regulating the layer thickness of the toner formed on the developing roller 4 (owing to the roller shape in the illustrated example, this device will be described below as the layer-thickness regulating roller 5, although an alternate shape such as that of a plate may be used); a supply roller 6, which is provided in contact with the developing roller 4, for supplying the developing roller 4 with toner; and a stirring member 7 disposed in back of the supply roller 6. As will be set forth later, the developing roller 4, supply roller 6 and layer-thickness regulating roller 5 are connected to suitable bias power supplies so that each is supplied with a prescribed bias voltage. It should be noted that since the toner undergoes reversal development, use is made of a toner having a polarity identical with that of to which the image carrier 1 is charged.

These components will now be described in detail. A prescribed amount of the non-magnetic single-component toner is accommodated inside the developing vessel 3. Disposed at a position opposing the image carrier 1 is the developing roller 4, which has a length approximately equal to that of the image carrier 1 and extends in a direction parallel to the axis of the image carrier 1, in such a manner that part of the peripheral surface thereof is exposed to the side of the image carrier 1 through an opening 8 formed in the developing vessel 3. The amount of toner contained in the developing vessel 3 is such that the top of the supply roller 6 will be exposed and is monitored constantly by a sensor provided on a rear wall of the developing vessel 3. When the amount of toner falls below a predetermined amount, the sensor issues a command signal so that the toner will be replenished from a toner cartridge 9.

The developing roller 4 includes a resilient intermediate layer 12 formed about a center shaft 11 comprising an electrically conductive rigid body made of stainless steel or the like, and a resilient surface layer 13 formed on the outer periphery of the intermediate layer 12. The developing roller 4 is disposed in pressured contact with the surface of the image carrier 1, in such a manner that the surface layer 13 and intermediate layer 12 are resiliently deformed, over a nip zone width of 4 mm or greater, preferably 5 to 10 mm, and rotates in the forward direction with respect to rotation of the image carrier 1, i.e., in a counter-clockwise direction B.

The center shaft 11 of the developing roller 4 is connected to a bias power supply 14*a* via a switch 31. The bias power supply 14*a* applies a bias voltage for preventing fogging of toner on the image background. The bias voltage is set to a value lower than the surface potential of the image carrier 1 by 100 to 500 V, preferably 300 to 400 V, in terms of absolute value. If the potential difference is made less than 300 V, the density of development will decline; if it is made 400 V or greater, cleaning will become difficult and it will tend to be difficult to obtain a high-quality reproduced image.

In the illustrated example, a second bias power supply 14*b* the polarity of which is opposite that of the bias power supply 14*a* is provided. Connection to either of these bias voltages is made by changing over the switch 31. The changeover is made at a predetermined timing at the time of image formation, which is when the developing roller 4 mainly takes part in development, and at such time that the developing roller 4 takes part mainly in cleaning before image formation or during idling between image formation processes. That is, at the time of development, the switch is changed over to a polarity identical with that of the potential to which the surface of the image carrier 1 is charged; at the time of cleaning, the switch is changed over to a polarity opposite that of the potential to which the surface of the image carrier 1 is charged.

With reference again to the structure of the developing roller 4, the intermediate layer 12 formed on the outer side of the center shaft 11 and the surface layer 13 formed on the outer peripheral surface of this intermediate layer are formed by a resilient body of two layers of different properties having volume resistance values such that the intermediate layer 12 will have a comparatively high resistance and the surface layer 13 a low resistance relative thereto, by way of example. For instance, silicone rubber can be used as one example of these resilient bodies. In such case, it is preferred that the silicone rubber constructing the intermediate layer 12 have a volume resistance of $10^4$ to $10^9$ Ω·cm and that the silicone rubber constructing the surface layer 13 have a volume resistance of $10^5$ to $10^9$ Ω·cm.

The developing roller 4 is not limited to such a two-layer structure; it may have a single-layer structure or, conversely, a structure of three or more layers. A material other than silicone rubber may be used. A resilient material (inclusive of a porous foamed body) such as NBR rubber (acrylonitrile-butadiene copolymer rubber) or urethane rubber may be used as the intermediate layer 12, and an article formed from a resilient body such as urethane rubber may be used as the surface layer 13. Further, a single-layer-type developing roller, consisting of a layer of NBR rubber, urethane rubber or silicone rubber, etc., may be used.

The specific resistance of the resilient layer of a single-layer developing roller or the specific resistance of the resilient layers comprising the intermediate layer and surface layer of a multiple-layer developing roller preferably falls within the range $10^5$ to $10^8$ Ω·cm, and the rubber hardness preferably falls within the range 20 to 40°. In particular, the surface layer 13 (the outer surface in case of a single layer) preferably is formed by a material which has fine surface roughness in order to provide a toner transport capability, exhibits a good release property with respect to the toner and is separated from the toner in the triboelectric series.

The surface of the developing roller 4 differs depending upon the particle diameter of the toner. If the average particle diameter of the toner is 8 to 10 μm, then it is preferred that the surface of the developing roller 4 have roughness of about 10 Ω·m. A material having a low hardness of about 10 to 20° used as the core, and a resilient body having a hardness of 20 to 40° is used as the surface layer. Such a developing roller 4 is disposed in such a manner that the depth of bite into the image carrier 1 will be 0.2 to 3 mm, and preferably 1/100 times, especially 1/40 times, the radius of the developing roller 4 in a case where the radius of the developing roller 4 is less than 30 mm. The developing roller 4 carries out development by rotating at a peripheral speed substantially the same as that of the image carrier 1. What is important here is the roughness of the surface layer 13 and the apparent hardness of the surface of the developing roller 4. A low apparent hardness for the surface of the developing roller 4 is preferred because the rotational torque will be smaller.

The supply roller 6 situated in back of the developing roller 4 is disposed so as to extend in parallel with the axis of the developing roller 4 and contacts the developing roller 4 substantially along its full length. By way of example, the supply roller 6 comprises a foamed body of urethane rubber mixed with finely divided carbon powder. While contacting the developing roller 4 under a predetermined pressure, the supply roller 6 rotates in a direction opposite that in which the developing roller 4 rotates, i.e., counter-clockwise, supplies the developing roller 4 with toner from within the developing vessel 3 and electrically charges the toner on the developing roller 4 by triboelectrification. The charging of the toner by the friction between the developing roller 4 and supply roller 6 has a major influence upon quality of development. If charging is insufficient, fogging and density unevenness will occur.

A center shaft 16 of the supply roller 6 is connected to a bias power supply 14*c* via a Zener diode (not shown) so that the shaft is supplied with a predetermined bias voltage. The bias position applied to the supply roller 6 is set to a potential higher than the bias potential of the developing roller 4 by 100 to 200 V in terms of absolute value. Toner is transferred from the supply roller 6 to the developing roller 4 by this potential difference.

The stirring member 7 provided in back of the supply roller 6 has a center shaft 18 extending in the same direction as the axis of the developing roller 4, and a stirring blade 19 provided on the shaft at a plurality of locations along the direction of the axis. The stirring member 7 stirs the toner inside the developing vessel 3 by rotating and transports the toner to the supply roller 6 so that the toner is supplied. In this example, the stirring blade 19 rotates in the clockwise direction.

The toner supplied in layer form to the developing roller 4 by the supply roller 6 has its layer thickness regulated by the layer-thickness regulating roller 5. The layer-thickness regulating roller 5 comprises a conductive or semiconductive roller body which, in terms of the direction of rotation of developing roller 4, is disposed at a position upstream of the area of contact between the developing roller 4 and image carrier 1, i.e., upstream of the development nip zone, and has a length approximately the same as that of the developing roller 4. The layer-thickness regulating roller 5 is provided so as to rotate while part of its circumferential surface contacts the surface of the developing roller 4 at a predetermined pressure. In the illustrated example, the layer-thickness regulating roller 5 is placed directly above the developing roller 4. A bias voltage having a polarity identical with that of the supply roller 6 is applied to the layer-thickness regulating roller 5.

The layer-thickness regulating roller 5, which rotates in a direction opposite the rotating direction B of the developing roller 4, i.e., counter-clockwise, acts in such a manner that some of the toner affixed to the developing roller 4 is allowed to remain in a thin layer (one to three layers of the toner) on the developing roller 4 while the rest of the toner is removed by causing it to transfer to and be adsorbed by the circumferential surface of the layer-thickness regulating roller. The excess toner thus transferred by being peeled off by the layer-thickness regulating roller 5 is removed from the layer-thickness regulating roller 5 by a resilient removal blade 21 disposed in such a manner that its distal end is in abutting contact with the circumferential surface of the layer-thickness regulating roller 5.

The operation of the developing apparatus according to the present invention will be described next. In FIG. 1, first, with the image carrier 1 rotating in the direction of arrow A, the residual potential on the image carrier 1 is removed by the eraser lamp, then the surface of the image carrier 1 is charged uniformly by a charging device such as a corona charging device or charging roller. Digital exposure is then carried out by an exposure device to form an electrostatic latent image on the image carrier 1. The latent image is transported by rotation of the image carrier 1 to the position where the where the image carrier contacts the developing roller 4 of the developing apparatus 2, namely to the development nip zone.

Meanwhile, in the developing apparatus 2, the developing roller 4, supply roller 6 and stirring member 7 are rotated by driving sources (not shown) in the directions indicated by the respective arrows substantially at the same time that the image carrier 1 rotates, and predetermined bias voltages are applied to respective ones of the developing roller 4, supply roller 6 and layer-thickness regulating roller 5.

Owing to rotation of the stirring member 7 and supply roller 6, the toner inside the developing vessel 3 is stirred and supplied so that a toner layer is formed on the developing roller 4. The toner layer is regulated by the layer-thickness regulating roller 5 so as to become a uniform thin layer of one to three layers, after which the toner is carried to the development nip zone with rotation of the developing roller 4.

The toner of reduced thickness is supplied to the electrostatic latent image of the image carrier 1 in the development nip zone and the image is developed by attraction and affixing of the toner, whereby a visible toner image is formed.

The toner image is transported to a transfer area (not shown) by rotation of the image carrier 1. Here, by virtue of the action of a transfer device such as a transfer corona or transfer roller, an electric field whose polarity is opposite that of the toner is applied from the back side of the transfer medium so that the toner is transferred onto the transfer medium. The toner image that has been transferred is fixed onto the transfer medium at a fixing area, not shown. Meanwhile, residual toner on the image carrier not transferred to the transfer medium is subjected to full-surface exposure by the eraser lamp so that it attains a potential approximately the same as the potential of the dark portions of the image carrier (the potential of the image background). Next, charging and exposure for the formation of the next image are applied in a manner similar to that described above and the toner is then carried to the developing roller 4. The developing roller 4 allows the toner remaining on the image carrier 1 to be recovered in the developing apparatus 2 and supplies new toner to the surface of the image carrier 1 so that the next electrostatic latent image is developed.

Described next will be the drive sections of the developing roller 4 and the like as well as the positional relationship between the developing roller 4 and the image carrier 1 according to the present invention.

FIG. 2 is a diagram useful in describing the drive section of the developing apparatus 2. Flanges 10 are provided on both sides of the image carrier 1. Each flange 10 is concentric with respect to the image carrier 1 and the outer circumferential surface thereof substantially agrees with the outer circumferential surface of the image carrier 1. One of the flanges 10 is provided with a gear 15*a*. The gear 15*a* is disposed so as to mesh with a gear 15*b* supported on one end of the center shaft 11 of developing roller 4. Contact rollers 17, the operation of which will be described later, are provided on both ends of the center shaft 11 of developing roller 4. Each contact roller 17 is made of resin or metal and has a disk-shaped configuration and is provided on the center shaft 11 of developing roller 4 so as to be capable of rotating freely. The contact rollers regulate the amount of pressure the developing roller 4 applies to the image carrier 1 (the depth of bite) and rotate while in abutting contact with the ends of the image carrier 1 or with the flanges 10. When the contact rollers 17 are thus abutted against the flanges 10, the developing roller 4 abuts against the image carrier 1 at the width of the prescribed width zone and/or the depth of bite.

In a case where it is necessary to move the developing roller 4 (developing apparatus) in order to prevent damage to the image carrier 1 such as denting when the apparatus is not being used, the developing apparatus 2 is pulled away from the image carrier 1 (or loosened) by a cam, described later. Alternatively, when the apparatus is operating, the contact rollers 17 are urged toward the image carrier 1 by the cam until they come into abutting contact with the image carrier 1 or flanges 10.

Figure 3:
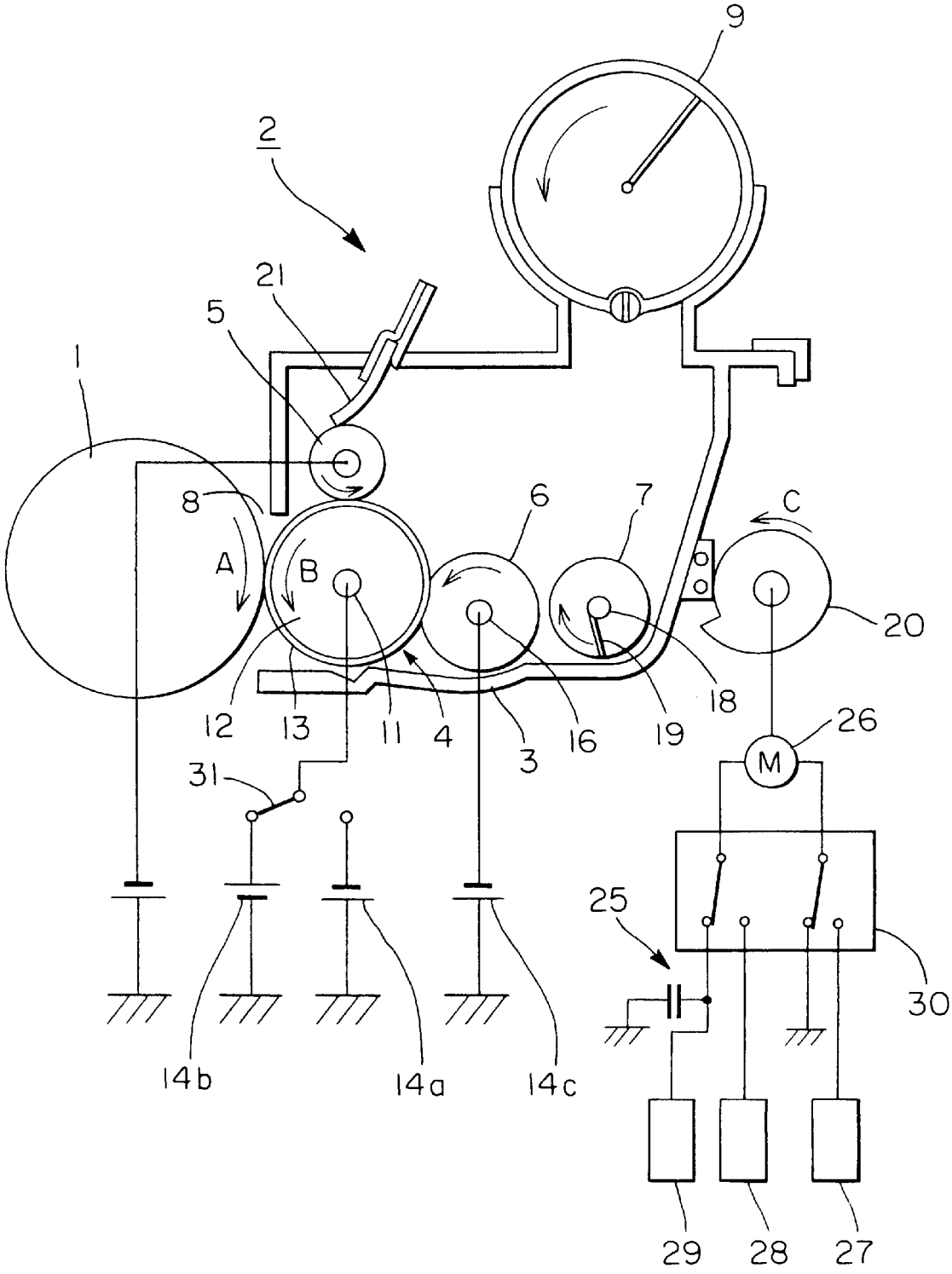
FIG. 3 is a schematic side view illustrating a state in which the developing apparatus has been moved in a direction in which it separates from an image carrier.

With reference again to FIG. 1, numeral 20 denotes the cam, which functions to bring the developing apparatus 2 into and out of contact with the image carrier 1. The cam 20 is situated with its cam face in abutting contact with part of the developing apparatus 2. When power is introduced from a power supply 28, the cam is rotated through a prescribed angle in accordance with a command from motor control means 27 so that the developing apparatus 2 is moved in a direction that urges it toward the image carrier 1, whereby the circumferential surface of the developing roller 4 is pressed against the circumferential surface of the image carrier 1. A capacitor 25 is provided so as to be charged during introduction of power in order that the cam 20 may be restored. When power is cut off, a changeover is made by switching means 30 in such a manner that the capacitor 25 serves as a temporary power source. As a result, the cam 20 is rotated and causes the developing apparatus 2 to move in a direction away from the image carrier 1 (FIG. 3). Numeral 22 denotes a frame supporting the center shaft 11 of the developing roller 4 and the center shaft 16 of the supply roller 6.

Operation attendant upon operation of the cam 20 will now be described in greater detail. FIGS. 1 and 3 are diagrams illustrating the relationship between the developing apparatus 4 and the image carrier 1 when power is respectively introduced to and cut off from the apparatus. In FIG. 1, the switching means 30 has two switches. During introduction of power, one switch is connected to the power supply 28 and the other switch is connected to the motor control means 27. In a case where this power supply is cut off in FIG. 3, the one switch is connected to the capacitor and the other is connected to ground.

When a main switch (not shown) on the main body of the apparatus is operated to turn on the power supply 28, the two switches of the switching means 30 are changed over from the positions shown in FIG. 3 to the positions shown in FIG. 1, whereby a motor 26 is connected to the power supply. On/off control of the motor 26 is performed based upon a signal from the motor control means 27. When power is introduced from the power supply 28, the motor 26 is driven for a prescribed period of time in accordance with an ON signal from the motor control means 27, i.e., until an angular position at which the cam face of the cam 20 contacts part of the developing apparatus 2 shifts from the minimum-diameter position of cam 20 shown in FIG. 3 to the vicinity of the maximum-diameter position shown in FIG. 1. More specifically, by virtue of such drive, the cam 20 turns in the direction of arrow c so that the developing apparatus 2 is moved in the direction of the image carrier 1 gradually in accordance with the shape of the cam face to thereby press the developing roller 4 against the image carrier 1 in such a manner that the developing roller 4 contacts the image carrier over the prescribed contact width (the width of the nip zone).

The turning of the cam (the rotational position of the cam) from the position shown in FIG. 3 to the position shown in FIG. 1 is sensed by position sensing means (not shown) such as a photosensor. The detection data is sent to the motor control means 27, whereby the motor control means 27 controls the drive timing of the motor 26.

Further, when power supply 27 is turned on, a charging signal is output from charging control means 29. The capacitor 25 is charged in accordance with this signal.

Next, as shown in FIG. 3, when the power supply 28 is cut off, the electricity that accumulated in the capacitor 25 by changeover of the switching means 30 drives the motor 26 to turn the cam 20 through the prescribed angle in the direction of arrow c, whereby the position shown in FIG. 3 is attained. Owing to this rotation of the cam 20, the developing apparatus 2 moves in a direction away from the image carrier 1 instantaneously through the cam step, whereby the pressing force of the developing roller 4 is relaxed or removed.

When the developing apparatus 2 is moved toward the image carrier 1 by the above operation of the cam 20 so that the developing roller 4 is pressed against the image carrier 1 over the prescribed width of the nip zone and/or by the prescribed depth of bite, the gear 15*a* provided on the image carrier 1 and the gear 15*b* provided on the developing roller 4 are meshed so that drive can be transferred. When the developing apparatus 2 is moved in the direction away from the image carrier 1 to relax or remove the pressing force of the developing roller 4, the gear 15*a* of the image carrier 1 and the gear 15*b* of the developing roller 4 are not completely separated from each other and the tips of the gears are in slight mesh with each other. As a result, the gears can be meshed by the pressing force of the developing roller 4 without the tips of the gears 15*a*, 15*b* clashing with each other.

Figure 4:
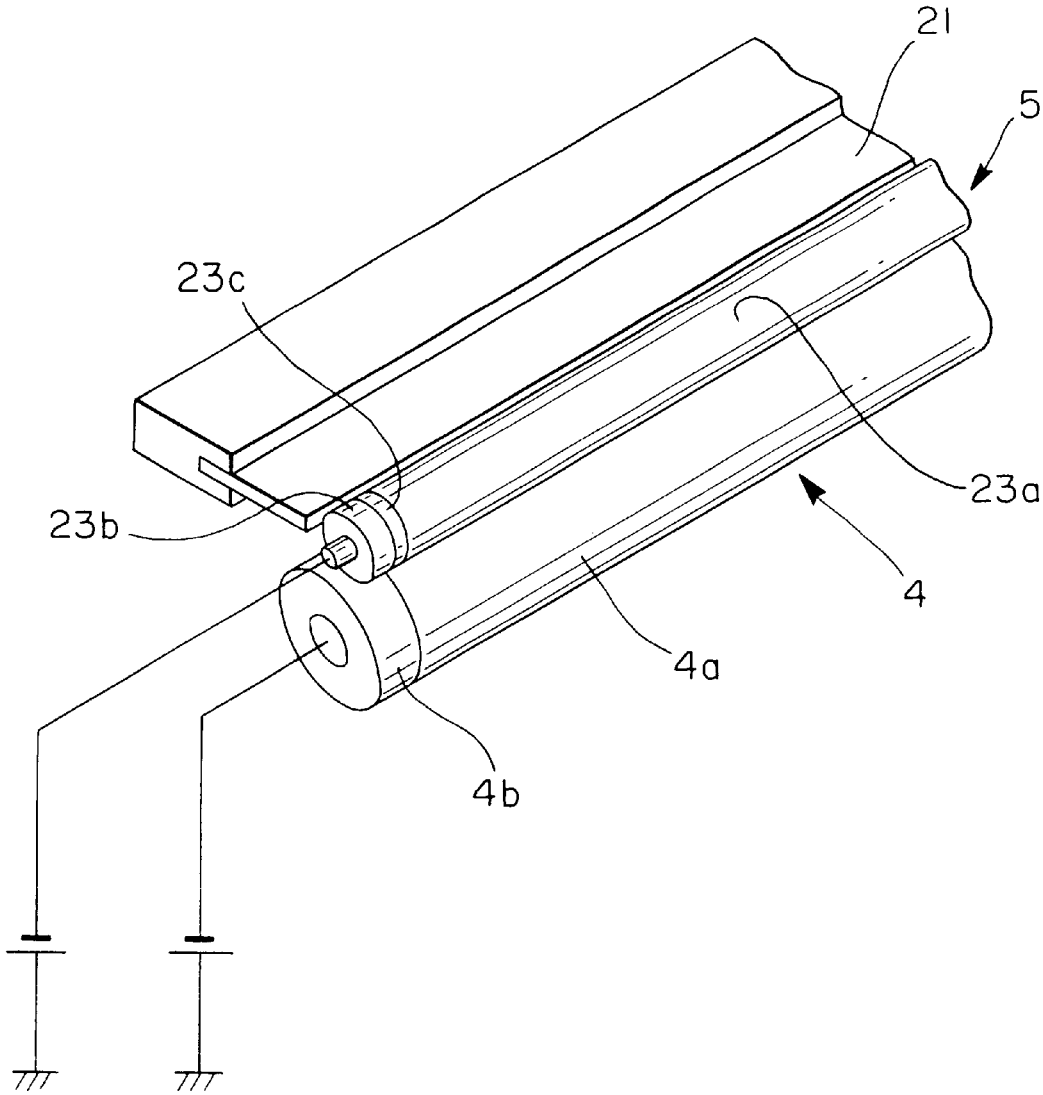
FIG. 4 is a perspective view of a developing roller and layer-thickness regulating roller.
Figure 5:
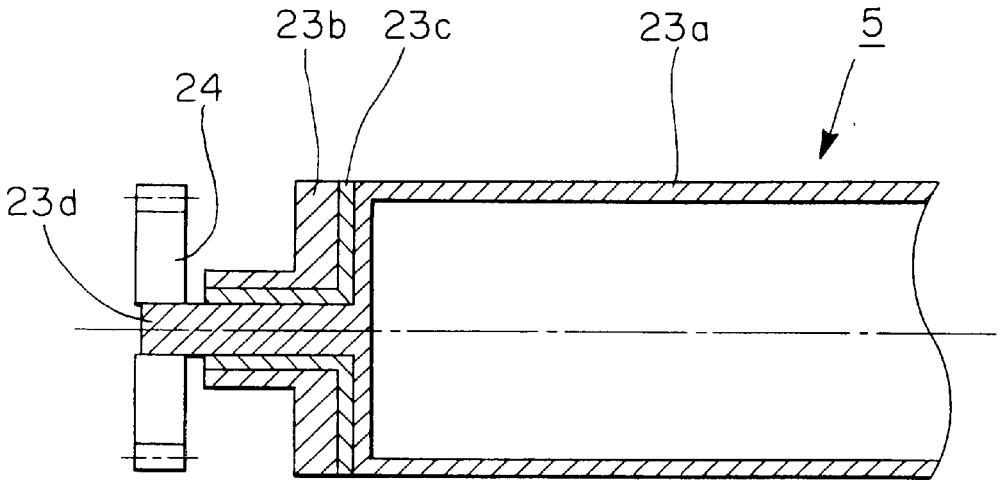
FIG. 5 is a sectional view of the layer-thickness regulating roller.

As shown in FIGS. 4 and 5, the layer-thickness regulating roller 5 is so constructed that a central portion 23*a* along the axial direction and end portions 23*b* are electrically insulated from each other. In the illustrated example, a collar 23*c* comprising an insulating resin is secured to a support shaft 23*d* (shown only in FIG. 5) of the central portion 23*a* so as to insulate and cover the support shaft 23*d* of the central portion 23*a* and the end face of the central portion 23*a*. The end portion 23*b* is secured to the outer side of the collar 23*c* in such a manner that its circumferential surface is flush with the surface of the central portion 23*a*. The insulating method naturally is not limited to one that relies upon the collar 23*c*; another insulating method such as one that uses an insulating coating may be used. Further, though only one end of the layer-thickness regulating roller 5 is illustrated in FIGS. 4 and 5, the other end also has a similar structure. Numeral 24 denotes a gear for transmitting a driving force, which is from a driving source that is not shown, to the layer-thickness regulating roller 5.

Bias potentials that differ from each other are applied to the electrically isolated central portion 23*a* and end portions 23*b* of the layer-thickness regulating roller 5 (one of these potentials may be ground potential, depending upon the potential of the developing roller 4). Basically, the potentials are decided in such a manner that all of the toner on the end portions 4*b* of the developing roller 4 will be transferred to the image carrier while no toner is affixed to the end portions 23*b* of the layer-thickness regulating roller 5, i.e., so that a toner layer is not formed on the end portions 23*b*. On the other hand, at the central portion 23*a*, the potentials are decided in such a manner that some of the toner that has attached itself to the central portion 23*a* of the layer-thickness regulating roller 5 will be left in a thin layer (one to three layers of toner) on the central portion 4*a* of the developing roller 4, while the rest of the toner is removed by causing it to transfer to and be adsorbed by the circumferential surface of the layer-thickness regulating roller. The excess toner transferred by being peeled off by the layer-thickness regulating roller 5 is removed from the layer-thickness regulating roller 5 by the resilient removal blade 21 disposed in such a manner that its distal end is in abutting contact with the circumferential surface of the layer-thickness regulating roller 5. As for the bias potentials, assume that the bias potential of the developing roller 4 is about −300 V. If the potential of the central portion 23*a* is made about −150 V and the potential of the end portions 23*b* is made less than about −50 V, then the effects described above can be obtained. Of course, the invention is not limited to such potentials, which can be decided freely within limits that provide the above-described effects.

EXAMPLE 1

A single-layer developing roller 4 having a diameter of 45 mm, a hardness of 35 to 40°, a volume specific resistance of about $3\times10^6$ Ω·cm and a surface roughness of about 10 μm was used. The developing roller 4 was disposed in such a manner that a development nip width (development nip zone) of 4.0 to 7.0 mm was obtained with respect to a drum-shaped OPC (Organic Photo-Conductor) photosensitive drum, and the developing roller 4 was rotated in the forward direction of the image carrier 1 at a peripheral speed substantially identical with that of the image carrier 1. A sponge roller having a volume specific resistance of $10^{4\sim5}$ Ω·cm was used as the supply roller 6. A bias of −400 V was applied to the developing roller 4 and a bias of about −750 V to the supply roller 6, the developing roller 4 was coated with toner having an average particle diameter of 10 μm by the supply roller 6, a toner layer was then formed by the layer-thickness regulating roller 5 in such a manner that the layer of toner on the developing roller 4 took on a thickness that was one to three times the average particle diameter of the toner, the toner layer was developed by bringing it into contact with the image carrier 1 on which had been formed an electrostatic latent image having a potential of about −750 V in dark areas and a potential of about −80 V is light areas, then the developed image was transferred to a transfer medium and fixed to obtain an excellent final image.

EXAMPLE 2

Use was made of an image carrier 1 comprising a drum-shaped OPC photosensitive drum having a diameter of 120 mm and a length of about 930 mm for supporting size A0, and a developing roller 4 having a diameter of 40 mm, a length of about 930 mm, an apparent surface hardness of 25 to 40°, a volume specific resistance of about $3\times10^6$ Ω·cm and a surface roughness of about 10 μm. The developing roller 4 was disposed in such a manner that the depth of bite of the developing roller 4 into the image carrier 1 was about 0.2 to 3 mm (1/40 to 3/20 times the radius of the developing roller) and such that the development nip width (development nip zone) was 3.5 to 10 mm, and the developing roller 4 was rotated in the forward direction of the image carrier 1 at a peripheral speed substantially identical with that of the image carrier 1, namely about 20 mm/s. A sponge roller having a volume specific resistance of $5\times10^4$ Ω·cm was used as the supply roller 6. A bias of −250 to 350 V was applied to the developing roller 4 and a bias of about −350 to 550 V to the supply roller 6, the developing roller 4 was coated with toner having an average particle diameter of 8 μm by the supply roller 6, a toner layer was then formed by the layer-thickness regulating roller 5 in such a manner that the layer of toner on the developing roller 4 took on a thickness that was one to three times the average particle diameter of the toner, the toner layer was developed by bringing it into contact with the image carrier 1 on which had been formed an electrostatic latent image having a potential of about −550 to 650 V in dark areas and a potential of about 20 V is light areas, then the developed image was transferred to a transfer medium and fixed to obtain an excellent final image.

EXAMPLE 3

A single-layer developing roller 4 having a diameter of 50 mm, a hardness of 40°, a volume specific resistance of about $10^8$ Ω·cm and a surface roughness of about 10 μm was used. The developing roller 4 was disposed in such a manner that a development nip width (development nip zone) of 4.8 to 6.0 mm was obtained with respect to a drum-shaped OPC photosensitive drum, and the developing roller 4 was rotated in the forward direction of the image carrier 1 at a peripheral speed substantially identical with that of the image carrier 1. A sponge roller having a volume specific resistance of $10^5$ Ω·cm was used as the supply roller 6. A bias of −325 V was applied to the developing roller 4 and a bias of about −575 V to the supply roller 6, the developing roller 4 was coated with toner having an average particle diameter of 8 to 10 μm by the supply roller 6, a toner layer was then formed by the layer-thickness regulating roller 5 in such a manner that the layer of toner on the developing roller 4 took on a thickness that was one to three times the average particle diameter of the toner, the toner layer was developed by bringing it into contact with the image carrier 1 on which had been formed an electrostatic latent image having a potential of about −700 V in dark areas and a potential of about −70 V is light areas, then the developed image was transferred to a transfer medium and fixed to obtain an excellent final image.

EXAMPLE 4

A single-layer developing roller 4 having a diameter of 100 mm, a hardness of 40°, a volume specific resistance of about $3\times10^7$ Ω·cm and a surface roughness of about 10 μm was used. The developing roller 4 was disposed in such a manner that a development nip width (development nip zone) of 4.0 to 4.6 mm was obtained with respect to a drum-shaped OPC photosensitive drum, and the developing roller 4 was rotated in the forward direction of the image carrier 1 at a peripheral speed substantially identical with that of the image carrier 1. A sponge roller having a volume specific resistance of $10^4$ Ω·cm was used as the supply roller 6. A bias of 325 V was applied to the developing roller 4 and a bias of about 575 V to the supply roller 6, the developing roller 4 was coated with toner having an average particle diameter of 8 μm by the supply roller 6, a toner layer was then formed by the layer-thickness regulating roller 5 in such a manner that the layer of toner on the developing roller 4 took on a thickness that was one to three times the average particle diameter of the toner, the toner layer was developed by bringing it into contact with the image carrier 1 on which had been formed an electrostatic latent image having a potential of about 650 to 700 V in dark areas and a potential of about 150 V is light areas, then the developed image was transferred to a transfer medium and fixed to obtain an excellent final image.

EXAMPLE 5

With respect to the image carrier 1 having an electrostatic latent image of negative polarity, the bias voltage of the developing roller 4 was made about −450 V, the bias voltage of the supply roller 6 was made about −750 V, the potential of the central portion 5*a* of layer-thickness regulating roller 5 was made about −200 V and the potential of the end portions 23*b* was made less than about −50 V when a copy was being made. During idling, the bias voltage of the developing roller 4 was made about +400 V, the bias voltage of the supply roller 6 was made about +750 V, the potential of the central portion 23*a* of layer-thickness regulating roller 5 was made about +650 V and the potential of the end portions was made about 800 V. It was possible to obtain an effect in which no toner adhered to the end portions 23*b* of the layer-thickness regulating roller 5 both at copying time and idle time.

EXAMPLE 6

With respect to the image carrier 1 having an electrostatic latent image of negative polarity, the bias voltage of the developing roller 4 was made about −400 V, the bias voltage of the supply roller 6 was made about −800 V, the potential of the central portion 23*a* of layer-thickness regulating roller 5 was made about −400 V and the potential of the end portions 23*b* was made about −0 V when a copy was being made. No toner adhered to the end portions 23*b* of the layer-thickness regulating roller 5. Further, during idling, the bias voltage of the developing roller 4 was made about +350 V, the bias voltage of the supply roller 6 was made about +750 V, the potential of the central portion 23*a* of layer-thickness regulating roller 5 was made about +350 V and the potential of the end portions was made about 0 V. It was possible to obtain an effect in which no toner adhered to the end portions 23*b* of the layer-thickness regulating roller 5.

EXAMPLE 7

With respect to the image carrier 1 having an electrostatic latent image of negative polarity, the bias voltage of the developing roller 4 was made about −250 V, the bias voltage of the supply roller 6 was made about −650 V, the potential of the central portion 23*a* of layer-thickness regulating roller 5 was made about −250 V and the potential of the end portions 23*b* was made about −150 V when a copy was being made. No toner adhered to the end portions 23*b* of the layer-thickness regulating roller 5. Further, during idling, the bias voltage of the developing roller 4 was made about +350 V, the bias voltage of the supply roller 6 was made about +750 V, the potential of the central portion 23*a* of layer-thickness regulating roller 5 was made about +350 V and the potential of the end portions was made about 0 V. It was possible to obtain an effect in which no toner adhered to the end portions 23*b* of the layer-thickness regulating roller 5.

In the development process according to the present invention capable of being realized by the foregoing examples, the traveling speed of the local portion of the developing roller 4 that contacts the surface of the image carrier 1 in the development nip zone extending from the point where contact with the developing roller 4 starts to the point where contact is broken is approximately the same as the peripheral speed of the image carrier 1 at the point where contact starts. However, it is believed that owing to the resilience of the developing roller 4 per se and due to a change in the radius in the local portion of the developing roller in the development nip zone caused by the developing roller 4 biting into the image carrier 1, the developing roller 4 operates so as to break contact with image carrier while the traveling speed of the local portion thereof gradually becomes lower than the peripheral speed of the image carrier and thenceforth gradually returns to the original speed.

The development nip zone and/or the depth of bite of developing roller 4 into image carrier 1 are important factors in order to achieve an optimum sharp image (and cleaning). Outside of the above-mentioned range (conditions), the contact between the developing roller 4 and image carrier 1 is unstable and there is a strong tendency for the appearance of development unevenness. As a result, it has been discovered that the width of the nip zone preferably is 4 mm or greater. Further, it has been clarified that in a case where the radius of the developing roller 4 is less than 30 mm, the depth of bite should be 1/100 of the radius of the developing roller 4 or greater, preferably 1/40 of the radius or greater. Furthermore, the motion of the local portion of developing roller 4 in the development nip zone functions well in regard to cleaning of residual toner on the image carrier 1. Specifically, it is believed that the residual toner on the image carrier 1 is subjected to a blade effect for removing the toner by the motion of the local portion that causes a change in traveling speed, as mentioned above, and the roughness on the surface of the developing roller 4, thereby providing excellent cleaning.

Furthermore, in a case where the image carrier 1 and developing roller 4 are of the contact type, as illustrated in the above example, there is no limitation upon the toner but, since the toner will leak if the resistance value is too low, a toner having a high resistance or insulating property of $10^6$ Ω·cm or higher is used. In particular, the toner desirably is a polymer toner or crushed toner of spherical shape having a particle diameter of 5 to 10 μm and an amount of charge of 30 μC/g, preferably 50 μC/g or greater.

Figure 6:
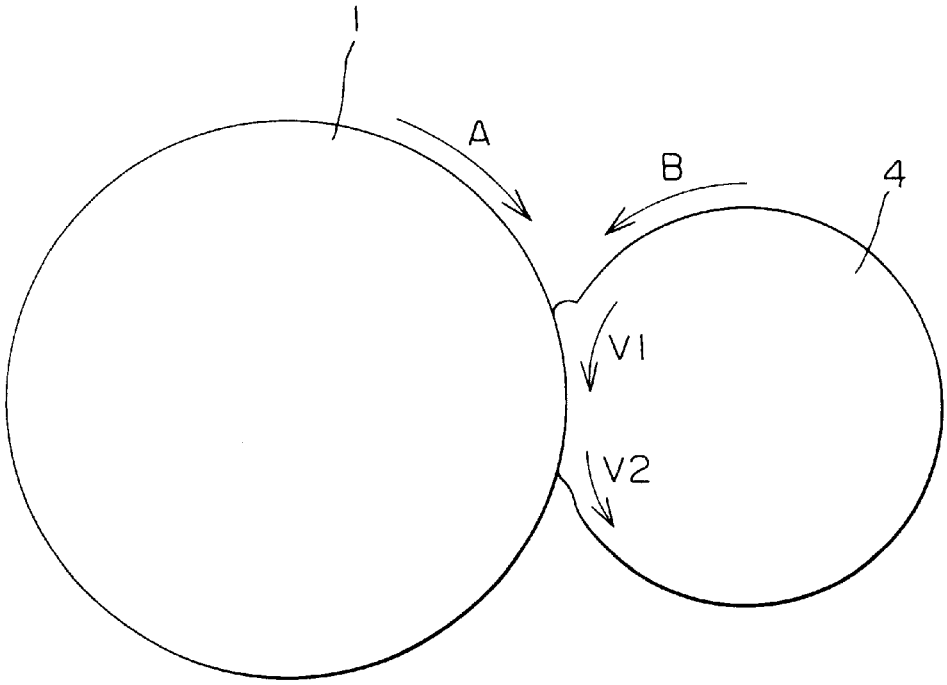
FIG. 6 is an enlarged sectional view of the image carrier and developing roller.

As shown in FIG. 6, with regard to the traveling speed of the image carrier 1 (which comprises a drum-shaped image carrier in the illustrated example), the peripheral speed A thereof and the peripheral speed B of the developing roller 4 are approximately identical. The arrangement is such that under these conditions, the developing roller 4 contacts the image carrier 1 over a considerable nip zone width and with a considerable depth of bite. As a consequence, the local traveling speed (the traveling speed of the local portion) of the surface of the developing roller in the zone from the entrance (the side of the contact starting point) of the development nip zone to the exit thereof (the side of the point where contact is broken) is not uniform. For example, sag at a bulge formed at the entrance causes some delay in speed in the formation of the nip. In addition, the radius of the developing roller 4 is shortened owing to gradual squeezing. As a result, the speed (V1) at the bulge gradually becomes lower than the peripheral speed B of the developing roller 4. This "slowness" brings about maximum slowness on a line connecting the center of the image carrier 1 and the center of the developing roller 4 (owing to maximum shortening of the radius of developing roller 4). Next, with restoration of the radius toward the exit, the original speed (V2), namely the peripheral speed B, is gradually restored. Strictly speaking, the developing roller 4 subjects the surface of the image carrier 1 to a rubbing action at the entrance owing to the aforementioned sag. Similarly, at the exit, the surface of the image carrier 1 is pulled owing to the restoration of the developing roller 4 to its original shape by virtue of the resilience of the roller that contracted in the nip zone. The developing roller 4 therefore travels at a speed somewhat higher than the peripheral speed subjects the image carrier 1 to a rubbing effect. Owing to these actions, the development of the electrostatic latent image on the image carrier 1 and the cleaning of residual toner are carried out effectively.

Thus, in accordance with the present invention, in a contact-type developing apparatus using a non-magnetic single-component toner, a satisfactory width can be set for the development nip zone and a satisfactory depth of bite can be set regardless of any variance in the diameter of the developing roller or any eccentricity of the roller, any change in diameter caused by a change in environment or any eccentricity of the image carrier. In addition, uneven rotation of the image carrier does not occur because development is carried out using approximately the same values for the peripheral speed of the image carrier and for peripheral speed of the developing roller. Since the width of the development nip zone and the depth of bite of the developing roller that abuts against the image carrier are selected to be large, any change therein is negligible. Furthermore, the width of the development nip zone ("nip width") is set to 4 mm or greater, preferably 5 to 10 mm, and the depth of bite of the developing roller is set to about 1/100 M4 of the radius of the developing roller or greater, preferably 1/40 or greater. As a result, the peripheral speed of the toner layer on the developing roller gradually slows down, with respect to the peripheral speed of the surface of the image carrier, from the start of contact to substantially the center of contact, after which the speed of the toner returns to the peripheral speed of the image carrier from the center of contact to the point at which contact is broken. The developing operation and cleaning operation therefore take place simultaneously and it is possible to form a jitter-free, extremely sharp image. In particular, it is possible to obtain a sharp image that is free of the occurrence of white stripes, fogging and inadequate density even in development of large-size images.

Further, in a non-magnetic single-component developing apparatus in which a developing roller is pressed against an image carrier over a predetermined nip width by contact rollers, drive of the image carrier is transmitted to the developing roller by gears, thereby eliminating blurring of the image and making it possible to obtain stable images. Further, when the developing apparatus is not being used, the developing apparatus is moved in a direction away from the image carrier and the gear on the image carrier is meshed with the gear on the developing roller slightly to such an extent that the gears do not separate completely. As a result, the gears can mesh smoothly and will not be damaged by re-application of the pressing force from the developing apparatus.

Furthermore, owing to a simple arrangement in which a layer-thickness regulating roller is utilized above the developing roller, affixing of toner to both end portions of the developing roller is prevented, as a result of which it is possible to effectively prevent leakage of toner from both ends of the developing roller to the exterior of the developing apparatus.

What is claimed is:

1. A developing apparatus for forming a thin layer of toner, comprising:

a resilient developing roller for receiving a non-magnetic single-component toner;

means for bringing said roller into abutting contact with a surface of an image carrier, whereby toner on the resilient developing roller is supplied to an electrostatic latent image previously formed on the surface of the image carrier, thereby developing the electrostatic latent image; and means for moving the image carrier and the resilient developing roller in a forward direction so that a travelling speed of the image carrier and a peripheral speed of the resilient developing roller become substantially identical, wherein:

a width of a development nip zone that extends from a point at which the resilient developing roller starts to contact the image carrier to a point at which the resilient developing roller breaks contact with the image carrier is at least 4 mm, a rubber hardness of the resilient roller is 20 to 40° measured according to the JIS K 6253 (Type A) standard and a diameter of the resilient developing roller is within the range 40 to 100 mm, and an amount of bite by which the surface of the image carrier bites into the resilient developing roller is equal to or greater than 1/100 of the radius of the resilient developing roller, and the amount of bite and the width of the development nip zone are such that the resilient developing roller breaks contact with the image carrier while a travellng speed of a local portion of the resilient developing roller in contact with the surface of the image carrier gradually decreases from the point at which contact starts and thenceforth gradually returns to the original speed due to resilience of the resilient developing roller.

2. The developing apparatus according to claim 1, wherein said amount of bite is at least 1/40 of the radius of the developing roller.

3. The developing apparatus according to claim 2, wherein said amount of bite is 0.2 to 3 mm.

4. The developing apparatus according to claim 3, wherein the thin layer of toner formed on said resilient developing roller is a uniform layer of one to three layers of toner.

5. The developing apparatus according to claim 4, additionally comprising means for forming said thin toner layer, which means comprises a layer-thickness regulating roller located in opposition to the developing roller.

6. The developing apparatus according to claim 5, wherein said layer-thickness regulating roller has a central portion along the axial direction thereof and end portions that are electrically insulated from the central portion, and the developing apparatus further comprises means for applying a bias voltage to the end portions for preventing adhesion of toner to the end portions of the resilient developing roller.

7. The developing apparatus according to claim 6, further comprising a scraping blade located in pressured contact with a central portion of said layer-thickness regulating roller with respect to the axial direction thereof and with end portions of said roller, said scraping blade adapted for scraping off toner that has adhered to the layer-thickness regulating roller.

8. The developing apparatus according to claim 1, wherein said developing roller is configured for contacting and separating from the surface of said image carrier, both ends of said developing roller comprise contact rollers, and said contact rollers are in abutting contact with both ends of said image carrier to regulate the width of said development nip zone.

9. The developing apparatus according to claim 1, further comprising means for moving said image carrier and said developing roller to mesh a gear located on a flange of the image carrier with a gear located on an end of the developing roller, whereby drive force from said image carrier is transmitted to the developing apparatus.

10. The developing apparatus according to claim 9, further comprising separation means for causing said developing apparatus to separate from said image carrier, wherein the gear located on said image carrier and the gear located on said developing roller are slightly meshed when said image carrier and said developing roller are in a separated state.

11. The developing apparatus according to claim 10, further comprising a cam in abutting contact with a portion of the developing apparatus for being turned at introduction of power to thereby move the developing apparatus in such a manner that said developing roller is pressed against said image carrier, and by provision of a capacitor charged when power is being introduced, wherein said capacitor is switched over to act as a power source at cut-off of power, thereby rotating said cam and moving the developing apparatus in such a manner that said developing roller moves in a direction in which it separates from said image carrier.

12. The developing apparatus according to claim 1, wherein the thin layer of toner formed on said resilient developing roller is a uniform layer of one to three layers of toner.

13. The developing apparatus according to claim 1, wherein said means for forming said thin toner layer comprises a layer-thickness regulating roller placed in opposition to the developing roller.

14. The developing apparatus according to claim 13, wherein said layer-thickness regulating roller has a central portion along the axial direction thereof and end portions that are electrically insulated from the central portion, and further comprises means for applying a bias voltage to the end portions for preventing adhesion of toner to the end portions of the resilient developing roller.

15. The developing apparatus according to claim 14, further comprising a scraping blade in pressured contact with a central portion of said layer-thickness regulating roller with respect to the axial direction thereof and with end portions of said roller, said scraping blade adapted for scraping off toner that has adhered to the layer-thickness regulating roller.

16. A developing apparatus for forming a thin layer of toner, comprising:

a resilient developing roller for receiving a non-magnetic single-component toner; and means for bringing said roller into abutting contact with a surface of a drum-shaped image carrier, whereby toner on the resilient developing roller is supplied to an electrostatic latent image that previously formed on the surface of the image carrier, thereby developing the electrostatic latent image, wherein:

moving the image carrier and the resilient developing roller in a forward direction so that a travelling speed of the image carrier and a peripheral speed of the resilient developing roller become substantially identical, and setting an amount of bite by which the surface of the image carrier bites into the resilient developing roller and width of a development nip zone that extends from a point at which the resilient developing roller starts to contact the image carrier to a point at which the resilient developing roller breaks contact with the image carrier, so that the resilient developing roller breaks contact with the image carrier while a travelling speed of a local portion of the resilient developing roller in contact with the surface of the image carrier gradually decreases from the point at which contact starts and thenceforth gradually returns to the original speed owing to resilience of the resilient developing roller, a layer-thickness regulating roller located in opposition to the developing roller and serving as means for forming said thin toner layer has a central portion along the axial direction thereof and end portions that are electrically insulated from the central portion, and a bias voltage for preventing adhesion of toner to the end portions of the resilient developing roller is applied to the end portions.

17. The developing apparatus according to claim 16, further comprising a scraping blade located in pressured contact with a central portion of said layer-thickness regulating roller with respect to the axial direction thereof and with end portions of said roller, said scraping blade adapted for scraping off toner that has adhered to the layer-thickness regulating roller.

18. A developing apparatus for forming a thin layer of toner, comprising:

a resilient developing roller for receiving a non-magnetic single-component toner; and means for bringing said roller into abutting contact with the surface of an image carrier, whereby toner on the resilient developing roller is supplied to an electrostatic latent image previously formed on the surface of the image carrier, thereby developing the electrostatic latent image, wherein:

moving the image carrier and the resilient developing roller in a forward direction in such a manner that a travelling speed of the image carrier and a peripheral speed of the resilient developing roller become substantially identical, setting an amount of bite by which the surface of the image carrier bites into the resilient developing roller and width of a development nip zone that extends from a point at which the resilient developing roller starts to contact the image carrier to a point at which the resilient developing roller breaks contact with the image carrier so that the resilient developing roller breaks contact with the image carrier while travelling speed of a local portion of the resilient developing roller in contact with the surface of the image carrier gradually decreases from the point at which contact starts and thenceforth gradually returns to the original speed owing to resilience of the resilient developing roller, moving said image carrier and said developing roller to mesh a gear located on a flange of the image carrier with a gear located on an end of the developing roller, whereby drive force from said image carrier is transmitted to the developing apparatus; and by having separation means for causing said developing apparatus to separate from said image carrier, wherein the gear located on said image carrier and the gear located on said developing roller are slightly meshed when said image carrier and said developing roller are in a separated state.

19. The developing apparatus according to claim 18, further comprising a cam in abutting contact with a portion of the developing apparatus for being turned at introduction of power to thereby move the developing apparatus in such a manner that said developing roller is pressed against said image carrier, and by provision of a capacitor charged when power is being introduced, wherein said capacitor is switched over to act as a power source at cut-off of power, thereby rotating said cam and moving the developing apparatus in such a manner that said developing roller moves in a direction in which it separates from said image carrier.

20. The developing apparatus according to claim 1, wherein said width of a development nip zone is 5 to 10 mm.

21. A developing apparatus for forming a thin layer of toner, comprising:

a resilient developing roller for receiving a non-magnetic single-component toner; and means for bringing said roller into abutting contact with a surface of a drum-shaped image carrier, whereby toner on the resilient developing roller is supplied to an electrostatic latent image that previously formed on the surface of the image carrier, thereby developing the electrostatic latent image, wherein:

moving the image carrier and the resilient developing roller in a forward direction so that a travelling speed of the image carrier and a peripheral speed of the resilient developing roller become substantially identical, and setting an amount of bite by which the surface of the image carrier bites into the resilient developing roller and width of a development nip zone that extends from a point at which the resilient developing roller starts to contact the image carrier to a point at which the resilient developing roller breaks contact with the image carrier, so that the resilient developing roller breaks contact with the image carrier while a travelling speed of a local portion of the resilient developing roller in contact with the surface of the image carrier gradually decreases from the point at which contact starts and thenceforth gradually returns to the original speed owing to resilience of the resilient developing roller, the size of an image represented by said latent image is at least A2 size.

* * * * *